United States Patent [19]

Shunichi et al.

[11] 4,248,526

[45] Feb. 3, 1981

[54] CIRCUIT FOR DETECTING DOOR STATE IN COPYING APPARATUS

[75] Inventors: Abe Shunichi; Mistuo Akiyama, both of Hachioji, Japan

[73] Assignee: Konishiroku Photo Industry Co., Ltd., Tokyo, Japan

[21] Appl. No.: 1,056

[22] Filed: Jan. 5, 1979

[30] Foreign Application Priority Data

Jan. 13, 1978 [JP] Japan ..... 53-2645[U]

[51] Int. Cl.[3] ..... G03G 15/00

[52] U.S. Cl. ..... 355/14 R; 340/644; 355/3 R

[58] Field of Search ..... 355/3 R, 14; 340/545, 340/644

[56] References Cited

U.S. PATENT DOCUMENTS

| | | | |
|---|---|---|---|
| 3,692,401 | 9/1972 | Kawai | 355/3 R |
| 3,737,734 | 6/1973 | Nakamura et al. | 307/154 X |
| 4,048,666 | 9/1977 | Irie et al. | 355/14 X |

*Primary Examiner*—Fred L. Braun

*Attorney, Agent, or Firm*—Bierman & Bierman

[57] ABSTRACT

A level shift circuit for indicating the open or closed condition of an access door of a copier senses the powered condition of operating portions of the copier to which the supply of power is interrupted when the access door is open and provides a corresponding logic signal to a sequence control circuit of the copier. In the disclosed embodiment, a series-connected resistor and zener diode are connected to the copier operating portions to provide an output signal through an inverting buffer to the sequence control circuit.

6 Claims, 2 Drawing Figures

CIRCUIT FOR DETECTING DOOR STATE IN COPYING APPARATUS

The present invention relates to a circuit for detecting the opening and closing of a door of a copying apparatus. In particular, the present invention relates to a circuit for detecting the opening and shutting of a door suitable for a copying apparatus which permits the sequence control of the copying operations in a continuous manner even after a transient or temporary opening of the door in concern.

In a copying apparatus such as an electrophotographic copying apparatus, a series of treatments such as electric charging of a photo-sensitive medium, the exposure thereof to a light image of an original to be reproduced, development of the thus produced electrostatic image, cleaning of the photo-sensitive medium such as a rotatable drum, feeding of a recording sheet, transfer of a toner image to the recording sheet, fixation of the toner image and so forth, which are carried out in sequence in response to an initiation command signal, are controlled by a sequence control circuit which is adapted to control the power or mover devices such as motors, clutch or the like employed for effecting the treatments such as described above. When jamming of the recording sheet occurs in the course of the copying operation, a door of the copying apparatus is opened to eliminate jamming. In this case, it is common practice to interrupt temporarily the electric power supply to the power or mover devices for protecting the user from electric shock or the like, while the power supply to the sequence control circuit is maintained to allow the continuation of the control to be effected after the removal of the jamming.

Figure 1:
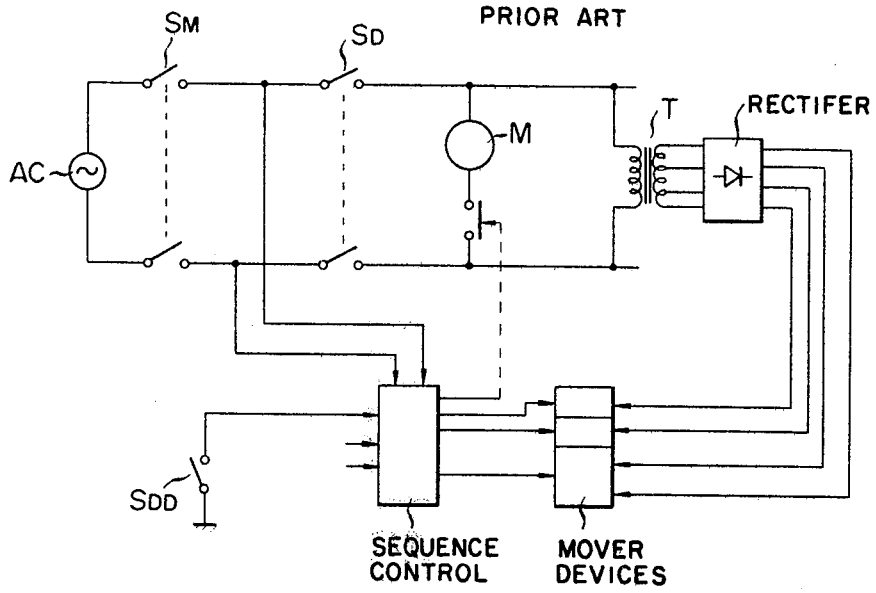
Figure 2:
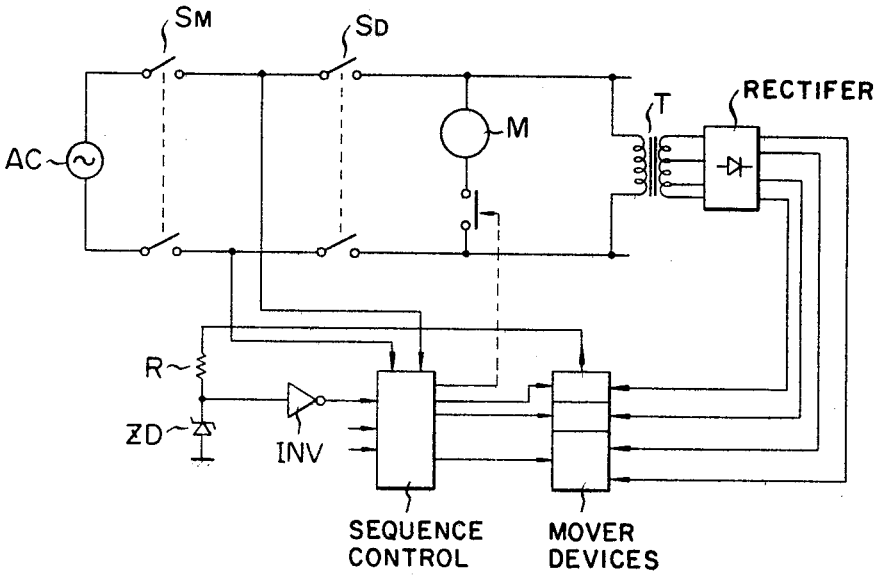

FIG. 1 is a circuit diagram of a hitherto known detecting circuit for detecting the opening and closing of a door of a copying apparatus, and FIG. 2 is a circuit diagram showing an embodiment of the present invention.

Referring to FIG. 1 which shows a circuit diagram to illustrate a hitherto known control system for a copying apparatus provided with a conventional circuit for detecting the opening and the closing of a door of the copying apparatus. A commercial power supply line passes through a main switch $S_M$ and a door switch $S_D$ which is opened and closed in response to the opening and closing of the associated door. Consequently, it is possible to supply an electric motor M, a transformer T and a circuit source of DC power for a rectifier circuit. The DC power supply source is adapted to supply electric energy to various mover devices required for the copying operation such as a clutch for coupling an original carrier plate to an associated drive device, except for the motor M. A sequence control circuit as well as a display circuit (not shown) for displaying the number of the copies as produced are connected to the AC power line in front of the door switch $S_D$ so that the power supply to the sequence control circuit and the display apparatus is not interrupted by the opening of the door switch $S_D$ so long as the main switch $S_M$ is closed, whereby the prevailing states of the various mover devices at the opening of the door switch $S_D$ are stored or held in the sequence control circuit to assure the regained control to be executed in a continuous manner. The input signals to the sequence control circuit include various detected signals such as timing signals and command signals required for controlling the copying operations and additionally the output signal from a door switch $S_{DD}$ for detecting the opening and the shutting of the door. The switch $S_{DD}$ may be constituted by a mechanical switch (e.g. micro-switch) which is operated in response to the opening and shutting of the door as in the case of the door switch $S_D$. Upon shutting of the door, an initiation signal is produced to allow the control by the sequence control circuit to be continued.

As will be appreciated from the foregoing description, the hitherto known detector circuit for detecting the opening and shutting of a door requires an additional switch $S_{DD}$ for triggering the continued control operation of the sequence control circuit in addition to the door switch $S_D$ for interrupting the power supply to the various mover devices, involving additional expenditure.

An object of the present invention is to provide a circuit in which the opening and shutting of a door is detected from the interruption and the shutting of the mover devices or driving circuits therefor, whereby the door switch for triggering the continued operation of the sequence control circuit is spared.

FIG. 2 shows an exemplary embodiment of the present invention. The part of FIG. 2 which is different from the circuit shown in FIG. 1 is derived from the opening and shutting of the power supply circuit to the driving circuits for the mover devices. More particularly, a level shift circuit composed of series-connected voltage-dropping elements shown as a resistor R and a Zener diode ZD is connected to the DC power supply source for the drive circuit. The output signal from the level shift circuit taken from the juncture of the series-connected resistor R and zener diode ZD is applied to a buffer inverter INV, the output signal of which in turn is applied to the sequence control circuit as the door state detecting signal.

In the course of the copying operation, when the door in concern is opened, for removing the jamming state of the recording sheet, for example, the associated door switch $S_D$ is opened and the power supply to the mover devices and/or driving circuits therefor is interrupted, as a result of which the door state detecting signal applied to the sequence control circuit will become logic "1". When the door is closed again, the power is again supplied to the mover devices or driving circuits therefor, as a result of which a door state detecting signal of logic "0" is applied to the sequence control circuit. Since the driver circuits described above are frequently provided in the vicinity of or on the same substrate as the sequence control circuit, the door state detecting circuit including the Zener diode ZD and so forth can be formed in the same substrate as that of the sequence control circuit, whereby the wiring expenditure can be significantly reduced. In other words, the wiring between the door switch $S_{DD}$ which, if provided, is positioned in the vicinity of the door in concern and the sequence control circuit can be remarkably reduced.

The present invention is not restricted to the illustrated embodiment of the door state detecting circuit. Further, the input signal thereto can be derived from the relevant lines extending in the vicinity of the sequence control circuit.

As will be apparent from the above description, the present invention permits the hitherto required door state detecting switch for reestablishing the operation of the sequence control circuit after the closing of the door as well as wiring therefor to be omitted.

What we claim is:

1. In a copier having a source of power, an access door moveable between open and closed positions, a plurality of electrically powered devices for effecting operation of the copier, door-operated switch means connecting the devices to the source of power when the access door is closed and disconnecting them when the door is open, a sequence control circuit having an input connected to the source of power and its output connected to the devices for operating the same in desired sequential order, the improvement comprising means for supplying to the sequence control circuit a signal indicative of the closed or open position of the access door respectively in response to the application or lack of power to the devices.

2. In a copier according to claim 1, said signal supplying means comprising a level shift circuit having its input connected to the devices, and means in said level shift circuit providing a control signal to the sequence control circuit.

3. In a copier according to claim 2, said level shift circuit including a pair of series-connected voltage-dropping elements and said signal provided to the sequence control circuit being taken from the juncture of the series-connected elements.

4. In a copier according to claim 3, one of said series-connected voltage-dropping elements being a resistor and the other of said elements being a zener diode.

5. In a copier according to claim 4, said means for providing a control signal comprising buffer means connected between said juncture of the resistor and zener diode and the sequence control circuit.

6. In a copier according to claim 5, said buffer means comprising an inverter for providing a low state logic signal to the sequence control circuit when the access door is closed and a high state logic signal to the sequence control circuit when the access door is open.

* * * * *